US006773016B2

(12) United States Patent
Ochi

(10) Patent No.: US 6,773,016 B2
(45) Date of Patent: Aug. 10, 2004

(54) RIDE APPARATUS WITH PRIZE-GRABBING ARM

(76) Inventor: Yasushi Ochi, Oriental Sangyo, Ltd., 1-5, Hiranomachi, Hirano-ku, Osaka-shi Osaka 547-0045 (JP)

( * ) Notice: Subject to any disclaimer, the term of this patent is extended or adjusted under 35 U.S.C. 154(b) by 130 days.

(21) Appl. No.: 10/064,169

(22) Filed: Jun. 17, 2002

(65) Prior Publication Data

US 2002/0140171 A1 Oct. 3, 2002

Related U.S. Application Data

(63) Continuation of application No. PCT/JP00/08644, filed on Dec. 6, 2000, now abandoned.

(30) Foreign Application Priority Data

Dec. 16, 1999 (JP) ..... 11-356829
Sep. 18, 2000 (JP) ..... 2000-281255

(51) Int. Cl.[7] ..... A63G 31/00

(52) U.S. Cl. ..... 273/448; 273/441; 273/460; 472/29; 472/32

(58) Field of Search ..... 472/29, 32, 33; 273/447, 448, 441, 459, 460

(56) References Cited

U.S. PATENT DOCUMENTS 1,666,018 A * 4/1928 Mayette ..... 280/1.13
4,638,997 A * 1/1987 Clark ..... 273/336
4,767,117 A * 8/1988 Maio ..... 273/352
5,415,417 A * 5/1995 Reis, Jr. ..... 273/447
5,741,188 A * 4/1998 Levin et al. ..... 472/128

FOREIGN PATENT DOCUMENTS

| | | | |
|---|---|---|---|
| GB | 2207869 | * | 2/1989 |
| GB | 2223179 | * | 4/1990 |
| JP | 1-68087 U | | 5/1989 |
| JP | 1-68087 U | * | 5/1989 |
| JP | 5-53693 U | | 7/1993 |
| JP | 5-53693 U | * | 7/1993 |
| JP | 7-47173 A | | 2/1995 |
| JP | 07-047173 | * | 2/1995 |
| JP | 7-323144 A | * | 12/1995 |
| JP | 8-252378 A | | 10/1996 |
| JP | 8-252378 A | * | 10/1996 |
| JP | P2001-129265 A | * | 5/2001 |
| JP | 2001-232055 | * | 8/2001 |
| WO | WO 01/43843 A1 | * | 6/2001 |

* cited by examiner

*Primary Examiner*—Raleigh W. Chiu
(74) *Attorney, Agent, or Firm*—Judge Patent Firm

(57) ABSTRACT

Game apparatus that enables players themselves to bodily sense a feeling of reality and lively motion, and that enables satisfying curiosity regarding mechanical manipulations. The game apparatus is composed of: a holding section (6) for holding a plurality of grab articles (7); a ride apparatus (10) for players (Y) to board, adapted to be shiftable and/or rotatable; and a fetching device (25) attached onto the ride apparatus (10), for fetching grab articles (7) from the holding section (6) by player (Y) manipulations. By actions that manipulate the fetching device (25), a player (Y) can satisfy curiosity regarding mechanical manipulations, and can enjoy an amusement brimming with appeal. By boarding and traveling with the ride apparatus (10), the players (Y) themselves can bodily sense a feeling of reality and lively motion.

14 Claims, 16 Drawing Sheets

Prior Art

RIDE APPARATUS WITH PRIZE-GRABBING ARM

CROSS REFERENCE TO RELATED APPLICATIONS

This is a continuation of International Application PCT/JP00/08644, with an international filing date of Dec. 6, 2000, published in Japanese (not in English) under PCT Article 21(2) and now abandoned.

BACKGROUND OF THE INVENTION

1. Technical Field

The present invention relates to game apparatuses accommodating grab articles within a holding section and configured for play at catching the grab articles by manipulating fetching means equipped with grasping hands.

2. Description of Related Art

To date, apparatuses such as shown in FIG. 20 have been known as an example of the above-noted game apparatuses. As shown in the same drawing, the game apparatus 200 is composed of a casing-like body 201, a plurality of grab articles 203 that are accommodated in a holding section 202 furnished in the body 201, and fetching means 204 disposed above the grab articles 203 and within the holding section 202.

Each fetching means 204 is composed of a grasping hand 205 installed to be open/closable and configured for clasping a grab article 203 when closed; a support rod 206 that supports the grasping hand 205; a (not-illustrated) drive means for shifting the support rod 206 and grasping hand 205 omnidirectionally in up-and-down, left-and-right and back-and-forth directions; means for controlling the operation of the (not-illustrated) drive means and the grasping hand 205; and actuation buttons 207 that input signals to the (not-illustrated) controlling means and actuate operations of the (not-illustrated) drive means and grasping hand 205.

Further, a pitch-in port 208 is provided within the holding section 202, and meanwhile a take-out port 209 is provided in the apparatus body 201 opening on an outside face thereof. The pitch-in port 208 and take-out port 209 are communicated with each other.

Further, the grab articles 203 are made up of spherical transparent capsules and character goods, for example, housed in the capsules. Here, in some cases character goods as the grab articles 203 are stowed as they are, unpackaged.

The game apparatus 200 becomes operable by means of the actuation buttons 207 when a player inserts coins for a prescribed charge; the(not-illustrated) controlling means receives signals from the actuation buttons 207 and controls operations of the (not-illustrated) drive means and grasping hand 205 to have the grasping hand 205 execute predetermined specific motions it is to execute. Specifically, when for example the actuation button 207 for shifting the grasping hand 205 in the left-and-right direction is pressed, the grasping hand 205 in the same direction is caused to reciprocate back and forth from a home position; and when the push button is released, the grasping hand 205 is halted. Next, when the actuation button 207 for causing the grasping hand 205 to shift in the back-and-forth direction is pressed, the grasping hand 205 in the same direction is caused to reciprocate from the halt position; and when the push button is released the grasping hand 205 is halted and subsequently made to execute an ensuing series of auto-drive operations (grasping motions).That is, after the grasping hand 205 is caused to drop it is actuated to close; in due course it is elevated and along the way is caused to reciprocate in the left-and-right and back-and-forth directions; and after it is shifted to above the pitch-in port 208, the grasping hand 205 is actuated to open and in due course is returned to its home position. Here, the operations through the actuation buttons 207, by which the grasping hand 205 is caused to reciprocate in the left-and-right and back-and-forth directions, are each limited to a single time.

Thus, in terms of the game apparatus 200, by a player operating one time only the respective operation buttons 207 that shift the grasping hand 205 in the left-and-right and back-and-forth directions, after the grasping hand 205 is shifted to a position where it is judged that a capsule housing a desired character item can be grasped it is halted, and thereafter the grasping hand 205 executes the above-noted series of grasping operations in auto-drive. If the capsule is grasped by the grasping hand 205, it is pitched into the pitch-in port 208. Then the capsule that has been pitched into the pitch-in port 208 is transferred to the take-out port 209 communicates with the pitch-in port 208, and the player may acquire the character item by taking out the capsule from the take-out port 209.

In this way, by means of the game apparatus 200, since a player is able mechanically to acquire desired character items by operating the fetching means 204 consisting of machinery, the player may satisfy curiosity regarding mechanical manipulations and enjoy an amusement brimming with appeal. Further, the fact that the operations for acquiring a character item are limited to a single time puts thrill into the game for the player to enjoy, and moreover lets recreational and material cravings to be able to get a character item be satisfied.

From another aspect, however, since the player him or herself is outside and merely operates the game apparatus 200, a realistic feel is lacking in that an element that lets the player him or herself sense things bodily is absent. The present inventor arrived at the present invention as a result of concerted efforts to develop a game apparatus that in addition to the actions and effects that the foregoing game apparatus 200 provides—which are: 1) enabling satisfaction of curiosity regarding mechanical manipulations, 2) enabling enjoyment of an amusement brimming with appeal, 3) enabling enjoyment of a thrilling game, and 4) enabling recreational and material cravings to be satisfied—lets players themselves bodily sense a feeling of reality, still further enables satisfying curiosity regarding mechanical manipulations, and still further enables enjoying an amusement brimming with appeal.

SUMMARY OF INVENTION

Accordingly, an object of the present invention is a game apparatus that enables players themselves to bodily sense a feeling of reality and lively motion, that enables satisfying curiosity regarding mechanical manipulations still more, and that enables enjoying still more an amusement brimming with appeal.

In order to achieve the above-described object, the present invention includes an holding section that holds and accommodates a plurality of objects in a fixed area, and a boarding portion on which a player boards, and is further provided with a ride apparatus in which the corresponding boarding portion is installed so as to move and rotate, and a fetching means that is attached to the corresponding ride apparatus and picks up one of the above-described objects from the above-described holding section by an operation made by the above-described player.

According to the invention, a player is able to enjoy himself as described below: That is, first, the player boards the boarding portion of a ride apparatus. Next, the ride apparatus moves or turns to an appropriate position automatically or by an operation made by the player. And, the player performs a game of picking up an object accommodated in an holding section by operating the fetching means attached to the ride apparatus. In such a game, the player is able to satisfy himself in regard to curiosity pertaining to mechanical operations, and enjoy himself in a game which is filled with interests. In addition, since the player can board the ride apparatus and move or turn thereon, the player can physically feel a sense of reality and enjoy the motions, and can satisfy himself in regard to the curiosity pertaining to the above-described mechanical operations. At the same time, he is able to enjoy a game that is filled with interests. If the above-described objects are decided to be premiums such as character goods in which players are keenly interested, the interest and material desire of the players for acquiring such character goods can be further satisfied.

The above-described ride apparatus may be composed of an operation portion that is used to move and rotate the above-described boarding portion, wherein the above-described boarding portion can be moved and turned by an operation of the player. Also, the above-described fetching means may be provided with a fetching portion for acquiring an object by picking it up, or may be provided with a hooking portion for acquiring an object by hooking it. Detailed examples of such a fetching portion may include a mechanism for directly grasping an object like a hand mechanism used for a robot, a mechanism for holding an object in a bucket such as a shovel mechanism that is used for a hydraulic power shovel or a bulldozer such as a civil engineering machine, a mechanism for adsorbing an object by an adsorbing means, or a mechanism for fetching an object by a dish-like or bucket-like container. Detailed examples of the hooking portion may include a hook mechanism, in which a hook-like curved member is movably provided, composed so as to pick up an object from the holding section by hooking it by means of the hook-like curved member, and a mechanism, in which a merely bar-like member is movably provided, composed so as to pick up an object from the holding section by hooking it by means of the bar-like member.

Also, the above-described ride apparatus may include various types of apparatuses, such as a vehicle moving by means of wheels, a ride apparatus, similar to a civil engineering machine, which can move by means of a caterpillar, a boat or an apparatus, composed so as to move by means of a swivel arm by which a seat on which a player sits is moved, which is similar to an apparatus installed in an amusement park. Further, the ride apparatus may be constructed so as to move along an appointed rail. Also, the ride apparatus moving along a rail may include a train, a ride apparatus similar to a monorail car, a boat moving along an appointed waterway, or other similar ride apparatuses.

In addition, if vibrating means are attached to the above-described fetching means, the degree of difficulty with respect to an action of picking up an object is increased by the fetching means, or the object that has been picked up may drop from the fetching means by vibration, wherein the degree of difficulty of the entire operation of the game is increased, and such a game will become more interesting to a player. Further, such vibrating means may employ a structure in which projections and recesses are provided in a runway of a ride apparatus, a structure in which the above-described fetching means is supported by resilient means, or a structure in which the fetching means itself is constructed so as to be likely to vibrate.

Further, the object that is picked up by the above-described fetching means may be discharged outside the playing area by providing a discharging means, or if the ride apparatus is provided with a collecting means, the object can be taken in the ride apparatus. If the discharging means is constructed so as to operate at random or in a fixed cycle, it becomes difficult to discharge the picked-up object outside the playing area, wherein the degree of difficulty of the game will be further increased so that the game becomes still more interesting. In addition, any type may be acceptable, if the above-described collecting means can receive the object picked up by the fetching means, by which the object can be taken in the ride apparatus. One of the examples is a mechanism that is provided with a collection port, which communicates with the inside of a ride apparatus, outside the ride apparatus, a mechanism that is composed so that an opening and closing door is provided in the ride apparatus and the above-described collecting port is formed by opening the door, or a mechanism that is composed so that a so-called fetching net secured so as to reciprocate between the inside and outside of the ride apparatus, and a structure similar thereto is disposed, and the picked-up object is collected by the fetching net. In addition, if the collecting port, opening and closing door, or fetching net is installed so as to move forward and backward, left or right at random or in a fixed cycle, it becomes more difficult for the above-described object to be collected in the ride apparatus, wherein the degree of difficulty is increased to cause the corresponding game to be made still more interesting.

DETAILED DESCRIPTION

Figure 1:
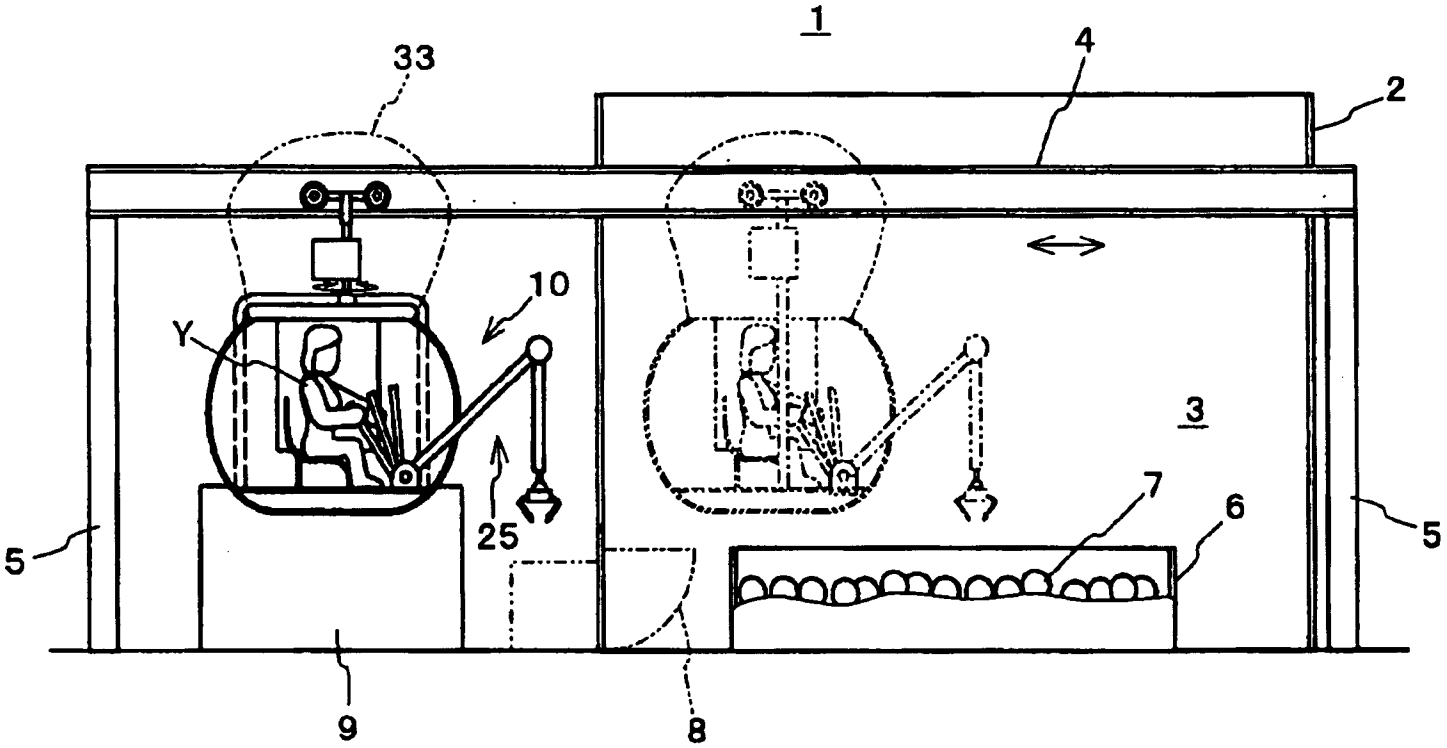
FIG. 1 is an elevational section view depicting overall a game apparatus according to a preferred embodiment of the invention.
Figure 2:
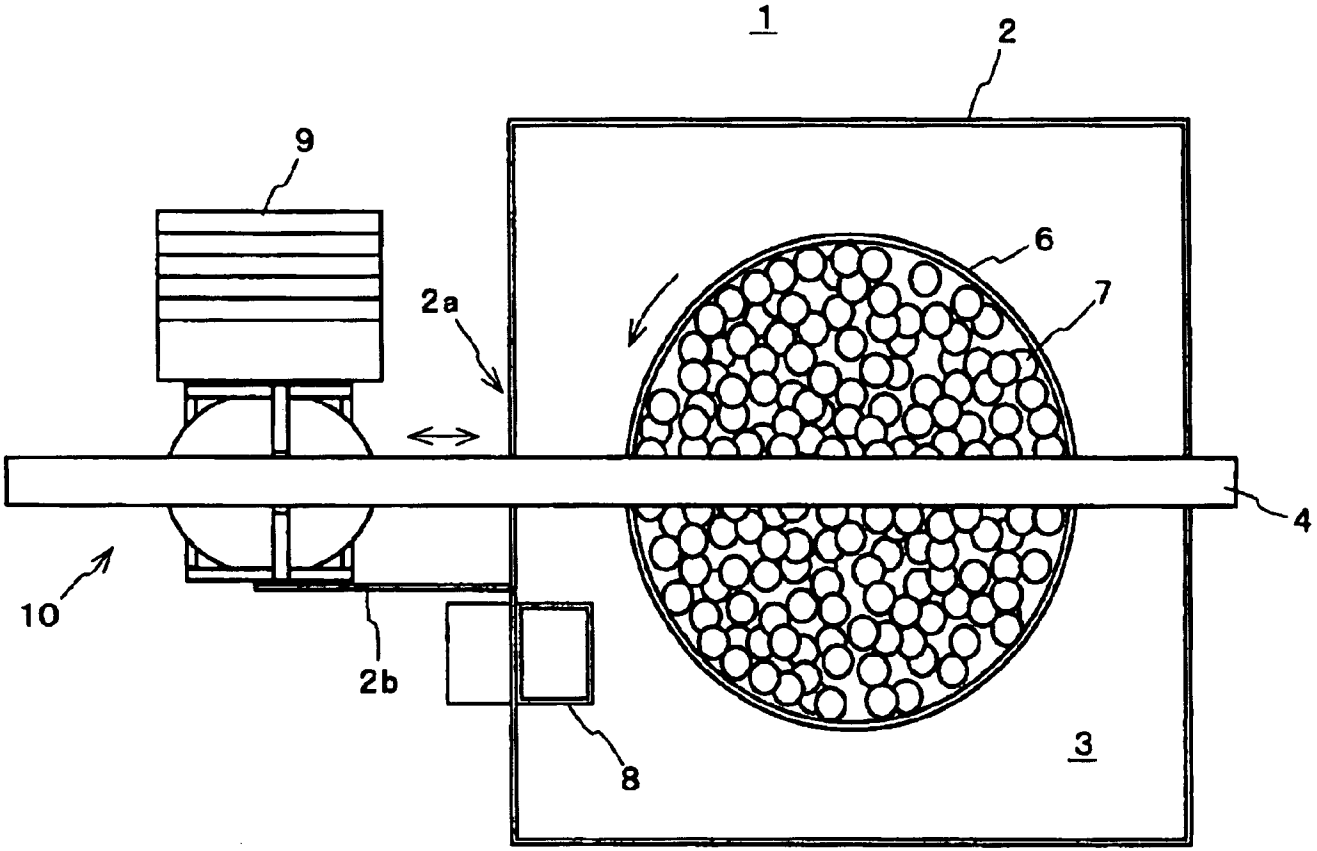
FIG. 2 is a plan view of the game apparatus shown in FIG. 1.
Figure 3:
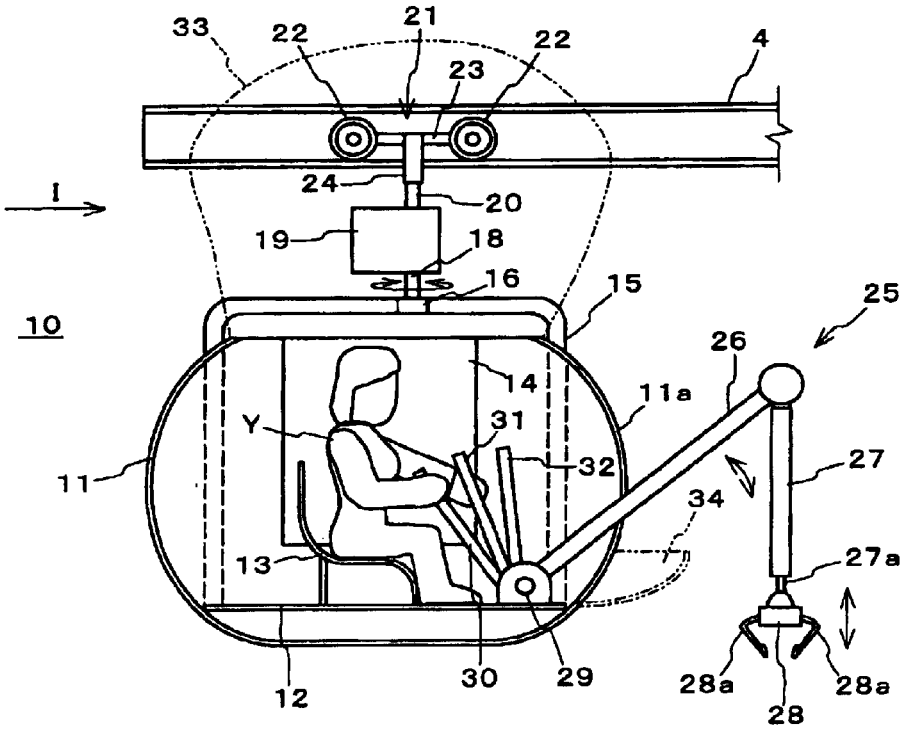
FIG. 3 is an enlarged view illustrating a ride apparatus.

Hereinafter, a description is given of detailed embodiments of the invention with reference to the accompanying drawings. FIG. 1 is a elevational section view showing overall a game apparatus according to a preferred embodiment of the invention; FIG. 2 is a plan view of the game apparatus shown in FIG. 1; FIG. 3 is an enlarged view showing a ride apparatus; and FIG. 4 is a lateral view taken along the arrow I direction in FIG. 3.

As shown in FIGS. 1 and 2, a game apparatus 1 according to this embodiment includes a partitioning member 2 that sections and forms a fetch-play area 3, an holding section 6, which is disposed in the fetch-play area 3, for accommodating and holding a plurality of grab articles 7, a running rail 4, one end of which is positioned in the fetch-play area 3, posts 5, 5 that support both ends of the running rail 4, a ride apparatus 10 that is hung from the running rail 4 and is composed so as to be movable in the lengthwise direction thereof, and a fetching device 25 attached to the ride apparatus 10.

Figure 4:
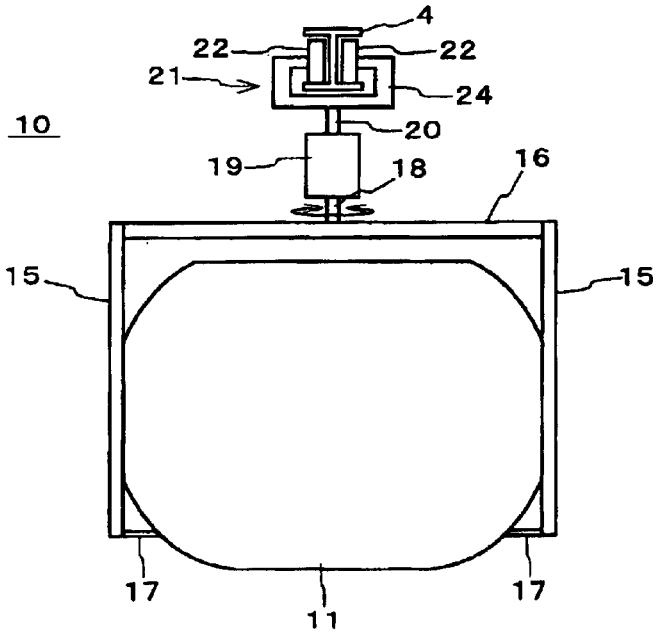
FIG. 4 is a lateral view taken along the arrow I direction in FIG. 3.

As shown in FIG. 3 and FIG. 4, the ride apparatus 10 is provided with a carriage device 21 that is engaged in and shifted along the running rail 4, and a rider vehicle 11 that is hung from the carriage device 21 and supported via a supporting rod 20, a rotating device 19, a supporting rod 18, a lateral frame 16, and frames 15.

The running rail 4 is made of a steel material whose cross section is I-shaped. The carriage device 21 is composed of two pairs of wheels 22, which are provided at an appropriate interval in the lengthwise direction of the I-shaped steel material at both sides of the vertical portion between the upper and lower ridges of the running rail 4, connection rods 23 that connect respective pairs of wheels 22, and a connection frame 24 that connects the pairs of connection rods 23. At least one of the wheels 22 is internally provided with a drive motor, wherein the drive motor drives and rotates the wheel 22, and the carriage device 21 moves along the lengthwise direction of the running rail 4 as described above. Also, the embodiment is such that the drive motor is incorporated in the wheel 22. However, the embodiment may be constructed so that a drive motor is provided outside, and the drive and rotation force is transmitted to the wheels 22 via gears and chains.

The supporting rods 20 and 18 are rotatably connected to each other via a rotating device 19, and the upper end of the supporting rod 20 is fixed on the lower end face of the connection frame 24. The rotating device 19 internally incorporates a drive motor, which causes the supporting rod 18 to rotate centering around the center axis thereof. The lateral frame 16 then is fixed at the lower end of the supporting rod 18, and the channel-shaped frames 15 are respectively fixed at either end thereof.

The rider vehicle 11 is made of a hollow structure whose appearance is roughly elliptical and spherical, wherein a floor member 12 is disposed therein, and a seat 13 on which a player Y sits is fixed on the floor member 12. Also, on its exterior the rider vehicle 11 is provided with a door 14, through which the player Y enters and leaves. Further, the upper part of the rider vehicle 11 is made open in order to eliminate a coped-up feeling for a player Y boarded therein. Further, the end parts of connection members 17 extending at both side edges of the floor member 12 are fixed at the lower ends of the frames 15, wherein the corresponding floor member 12 is supported by the frames 15. It is necessary that the rider vehicle 11 has a transparent window at its front side. It is further preferable to make the front window at the feet of the player Y transparent. Here, the rider vehicle may be made completely open on its front end.

Thus, the ride apparatus 10 moves in the direction of the arrow along the running rail 4 by operations of the carriage device 21, and reciprocates between the inside of the fetch-play area 3 and outside thereof, and the rider vehicle 11 et al. swivels and moves centering around the center of the supporting rod 18 by operations of the rotating device 19. Further, such motions may be carried out by the player Y operating an operation lever 30. For example, if the operation lever 30 is swung over frontward, the rider vehicle 11 is caused to move forward, and if the operation lever 30 is pulled toward the player Y, the rider vehicle 11 is caused to move backward. Also, by turning the operation lever 30 rightward centering around the axis, the rider vehicle 11 is caused to swivel in the same direction while, by turning it leftward, the rider vehicle 11 is caused to turn in the same direction.

One end of the fetching device 25 is supported by a bearing 29 disposed on the floor member 12, which includes a rocking arm 26 that is rockable in the arrow direction, an air cylinder 27 hung from the other end of the rocking arm 26, a grasping hand 28 fixed at the tip end of a piston rod 27*a* of the air cylinder 27, and a (not-illustrated) drive motor that causes the rocking arm 26 to rock and move. The rocking arm 26 is provided so as to protrude outward from a slit-like opening 11*a* that is formed on the rider vehicle 11, and is caused to rock along the vertical direction along the opening 11*a*. Also, the grasping hand 28 is provided with one pair of grasping claws 28*a* that are brought near or parted away from each other to open and close, and the grasping hand 28 is caused to ascend and descend by operations of the air cylinder 27.

A rocking motion of the rocking arm 26 is carried out by the player Y operating the operation lever 31. For example, by shifting the operation lever 31 down and forward, the rocking arm 26 is caused to rock downward; by pulling the operation lever 31 toward the player Y, the rocking arm 26 is caused to rock upward. In addition, the grasping hand 28 can be elevated and lowered by a player Y operating an operation lever 32, wherein for example, if the operation lever 32 is dropped down forward, the grasping hand 28 is lowered, and if the operation lever 32 is pulled to this side, the grasping hand 28 is elevated. Further, it is possible to open and close the grasping hand 28 by pressing an operation button (not illustrated) attached to the operation lever 32, wherein if the operation button (not illustrated) is pressed once, the grasping hand 28 is closed, and if the operation button is pressed again, the grasping hand 28 is opened.

The partitioning member 2 may be made of any material as long as it can section and form the area 3. However, it is further preferable that the partitioning member be composed of a transparent material such as an acrylic resin plate, since play in the fetch-play area 3 can be observed from the outside. Also, an opening portion 2*a* through which a ride apparatus 10 is let in and out is formed in the partitioning member 2 in a position that crosses the travelling path of the ride apparatus 10, and when the ride apparatus 10 enters the fetch-play area 3, the opening portion 2*a* is closed by the door 2*b*, and when the ride apparatus 10 comes out of the fetch-play area 3, the door 2*b* may be opened by its action.

Also, if the holding section 6 is made of a transparent material, although it may be composed of any material, it is most preferable that grab articles 7 accommodated therein can be observed from without. In addition, the holding section 6 is devised so as to horizontally rotate centering around the center axis thereof by means of an appropriate driving means (not illustrated). Further, the grab articles 7 may be composed of various types of character goods housed in transparent capsulate spherical containers. Also, a discharge duct 8 consisting of a duct-like member, which causes the inside of the fetch-play area 3 to communicate with the outside of the fetch-play area 3 via the interior of the duct, is provided at the partitioning member 2. Also, when the ride apparatus 10 is outside the fetch-play area 3 (that is, the home position), a steps 9 by which a player Y is able to board the ride apparatus 10 are provided in the vicinity of the home position.

As conditioned by the game apparatus 1, according to the present embodiment furnished with the above-described configuration, the player Y is able to enjoy playing a game of acquiring an grab article 7 as described below. Here, the ride apparatus 10 is at the home position, and the position thereof in its horizontal swivel direction, and the positions of the rocking arm 26 and grasping hand 28 are determined as shown in FIG. 1 (the situation is referred to as an original position), wherein the grasping hand 28 is opened.

First, a player Y climbs up the steps 9 to board the rider vehicle 11, and sits down on the seat 13. Next, the player Y makes the ride apparatus 10 advance forward by operating the operation lever 30 and further advance into the fetch-play area 3. Also, the holding section 6 is horizontally rotating in the fetch-play area 3 at an appropriate speed.

Next, the player Y makes the ride apparatus 10 advance, retreat or swivel horizontally by operating the operation lever 30, and makes the rocking arm 26 rock vertically by operating the operation lever 31. Then, the player Y moves the grasping hand 28 at a position where it is judged that a capsule in which an appointed grab article 7, that is, desired character goods are accommodated can be grasped. After that, the player lowers the grasping hand 28 to a desired position by operating the operation lever 32. And, in order to pick up a target capsule, the player Y presses the operation button (not illustrated) and closes the grasping hand 28 while watching the timing of the capsule swiveling in line with the rotating of the holding section 6.

Subsequently, when the player picks up a capsule with the grasping hand 28 as hoped, the player Y moves the grasping hand 28 appropriately upward of the discharge duct 8 by operating the operation levers 30, 31 and 32. After that, he opens the grasping hand 28 to input the grasped capsule into the discharge duct 8, thereby discharging the object outside the fetch-play area 3.

On the other hand, where the capsule could not be picked up by the grasping hand 28 or where he failed in inputting the capsule into the discharge duct 8, game continuation will not be permitted in this example, wherein the player Y returns the ride apparatus 10, rocking arm 26 and grasping hand 28 to their original positions after he opens the grasping hand 28, and next returns the ride apparatus 10 to the home position. Thereafter, he gets off from the ride apparatus 10.

Thus, according to the game apparatus 1 of the present embodiment, since a player Y is able to pick up desired character goods, by operating the fetching device 25 composed of the rocking arm 26, air cylinder 27 grasping hand 28 and other mechanisms, the players Y satisfy his or curiosity regarding mechanical manipulations, and can enjoy a game brimming with appeal. Also, since the player Y can play the game shifting or horizontally swiveling in the fetch-play area 3 while onboard the ride apparatus 10, the players Y themselves bodily sense a feeling of reality and lively motion attendant on the shifting and swiveling, such that curiosity regarding mechanical manipulations may be further satisfied, enabling the players Y to enjoy a game that is filled with interest.

Further, if the grab articles 7 preferably are made character goods in which the players Y are keenly interested, recreational and material cravings the players Y have for being able to get these can be satisfied, whereby further interest and curiosity with respect to a given game may be aroused in the players Y. Also, rotating the holding section 6 makes it difficult for the player Y to pick up a desired grab article 7, resulting in stimulated desire to play the game. In addition, if projections and dents are provided on the travelling path of the carriage device 21, the ride apparatus 10 is given vibrations when it travels on these projections and dents, and the vibrations are transmitted to the fetching device 25, the degree of difficulty will be further increased with respect to the fetching or grasping operation, and the degree of difficulty of the entire game will be increased, wherein the grab article 7 grasped once may fall from the grasping hand 28 due to vibrations, and the player Y will be further interested in a given game. As means for providing such vibrations, such structures in that the fetching device 25 is supported by resilient members, and the fetching device 25 is composed so as to vibrate readily may be employed in addition thereto. Also, in this embodiment, since the number of times of operation to pick up an grab article 7 is limited to one, the player Y can excitedly enjoy a game. However, it is optional that playing a game can be repeatedly tried within a fixed duration of time.

If decorations 33 such as media and literature characters are attached onto the exterior of the rider vehicle 11 to hide the carriage device 21, etc., the effect of the decorations can be increased. In addition, although the embodiment is constructed so that the grab article 7 grasped by the grasping hand 28 is discharged outside the fetch-play area 3 via the discharge duct 8, a collection portion 34 having a collection port may be provided at the front of the rider vehicle 11 as shown in FIG. 3, and the picked up grab article 7 may be collected into the rider vehicle 11 through the collection portion 34. Further, the collection portion 34 may be constructed so that the collection port is opened and closed. Also, the collection portion 34 is not limited to the structure shown in the drawing. The collection portion may be any optional type if it is able to receive the grab article 7 grasped by the grasping hand 28, wherein, for example, such a structure may be employed in which a so-called fetching net that is provided so as to reciprocate between the inside of the ride apparatus 10 and the outside thereof, or a structure similar thereto may be disposed, and the grab article 7 is collected by the fetching net, etc. In addition, the discharge duct 8, collection portion 34 or fetching net, etc., are provided so as to move forward and backward or leftward and rightward at random or at a fixed cycle, or the collection port of the collection portion 34 is opened and closed at random or at a fixed cycle, it will become difficult for the grab article 7 to be discharged outside the playing area 3, or to be collected into the ride apparatus 10, wherein the degree of difficulty of playing a game is increased, and interest in such a game will be deepened.

In the foregoing, a description was given of one embodiment of the invention. Needless to say, however, specific modes of the invention are not limited to the above-described embodiment. For example, modes that are shown in FIG. 5 through FIG. 19 may be employed.

Figure 5:
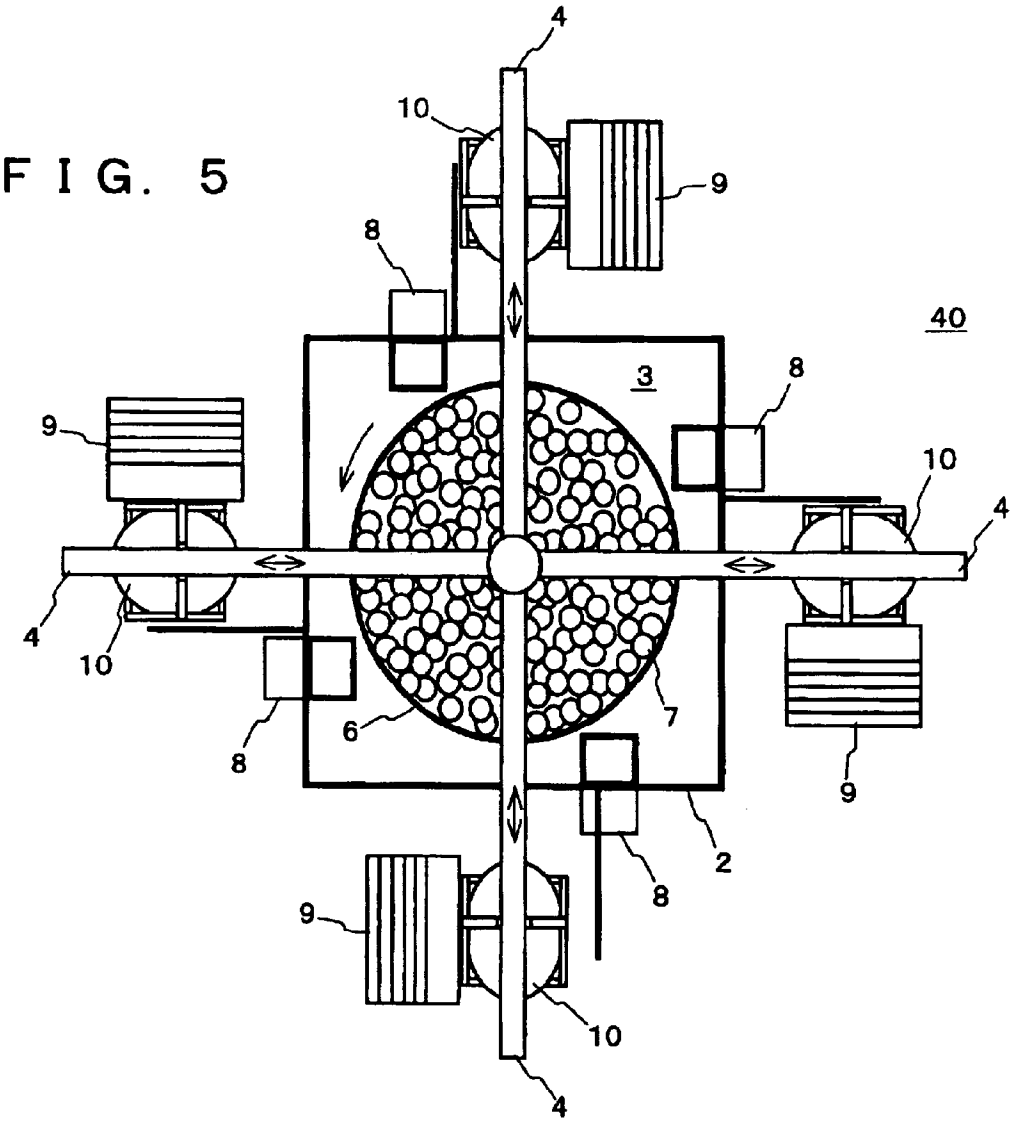
FIG. 5 is a plan view illustrating a game apparatus according to another preferred embodiment of the invention.

A game apparatus 40 according to a mode shown in FIG. 5 corresponds to a structure in which four sets of the game apparatus 1 consisting of the rider vehicle wherein four travelling rails 4 are disposed in the form of a cross in its plan view, a partitioning member 2 and an holding section 6 that horizontally rotates are disposed at the center of the cross, and rider vehicles 10 each provided with the fetching device 25 is hang from respective travelling rails 4. A steps 9 and a discharge duct 8 are provided so as to correspond to the respective rider vehicles 10. According to the game apparatus 40, since a plurality of players Y are caused to play games in parallel at the same time, a competitive spirit is produced among the players Y, and they are able to play the game with still further interest.

Figure 6:
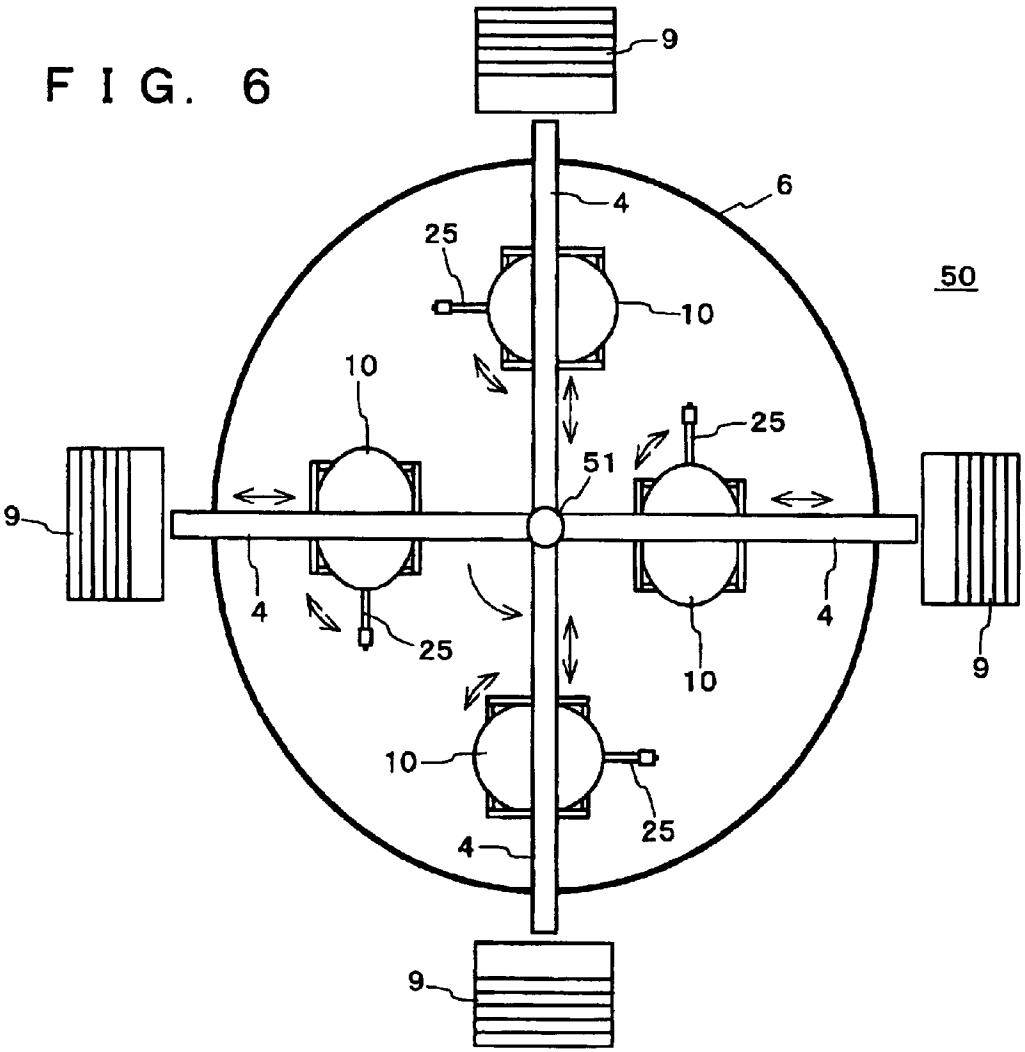
FIG. 6 is a plan view illustrating a game apparatus according to still another preferred embodiment of the invention.

A game apparatus 50 according to a mode shown in FIG. 6 is provided with a structure roughly equivalent to the apparatus 40, in which four travelling rails 4 are disposed in the form of a cross in its plan view, and the center thereof is supported by a post 51 secured that is rotatably supported at the axial center, an holding section 6 is disposed coaxially with the post 51, and rider vehicles 10 equipped with a fetching device 25 is hang from respective travelling rails 4. Further, a steps 9 are disposed so as to correspond to the respective rider vehicles 10. According to the game apparatus 50, since the post 51 is driven and rotated, the travelling rails 4 and rider vehicles 10 swivels and moves centering around the post 51. Thus, a game similar to that carried out by the game apparatus 10 is carried out in a state where the rider vehicles 10 swivel and move. Thus, according to the game apparatus 50, as in the game apparatus 40, since a plurality of players Y are caused to play in parallel at the same time, a competitive spirit is produced among the players Y, by which the game is made more interesting. Also, since a fetching game is carried out in a state where the ride apparatus 10 swivels and moves, the players Y can further physically feels a sense of reality and motions, and enjoy the game with still further interest.

Also, needless to say, in the game apparatuses 40 and 50, four sets of rider vehicles 10, etc., are provided. However, naturally, the number of sets is not limited to the four.

Figure 7:
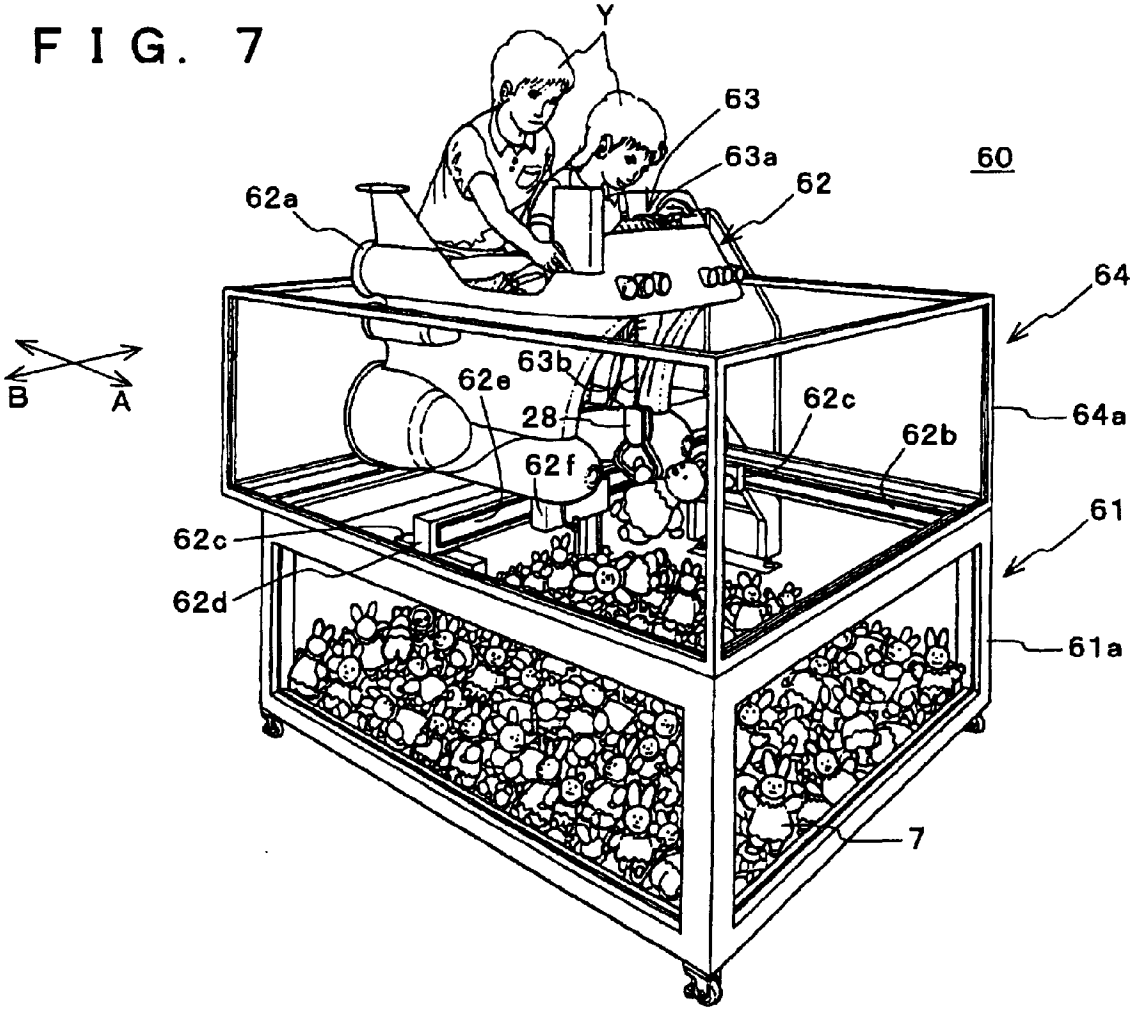
FIG. 7 is a perspective view illustrating a game apparatus according to still another preferred embodiment of the invention.

In addition, a game apparatus 60 according to a mode shown in FIG. 7 is provided with an holding section 61 that is formed like a casing and is provided with a number of grab articles 7 therein, a ride apparatus 62 in which a player Y boards, a cover member 64 secured on the holding section 61, and a fetching device 63 for picking an grab article 7 in the holding section 61.

The holding section 61 is provided with a frame 61*a* that is formed as a framework. The bottom of a space that is formed by the frame 61*a* is enclosed by a metallic plate, and the side is enclosed by a glass plate. Similarly, the cover 64 is also provided with a frame 64*a* that is formed as a framework, which is placed and fixed on the frame 61*a* of the holding section 61, wherein the side of a space that is formed by the frame 64*a* is enclosed by a glass plate. Also, the upper side of a space that is formed by the frame 61*a* and the upper side of a space that is formed by the frame 64*a* are, respectively, made open.

Figure 8:
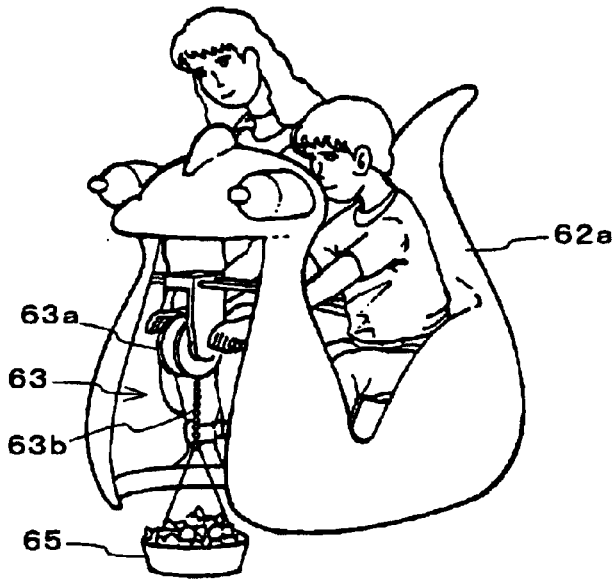
FIG. 8 is a perspective view illustrating another embodiment of the ride apparatus.
Figure 9:
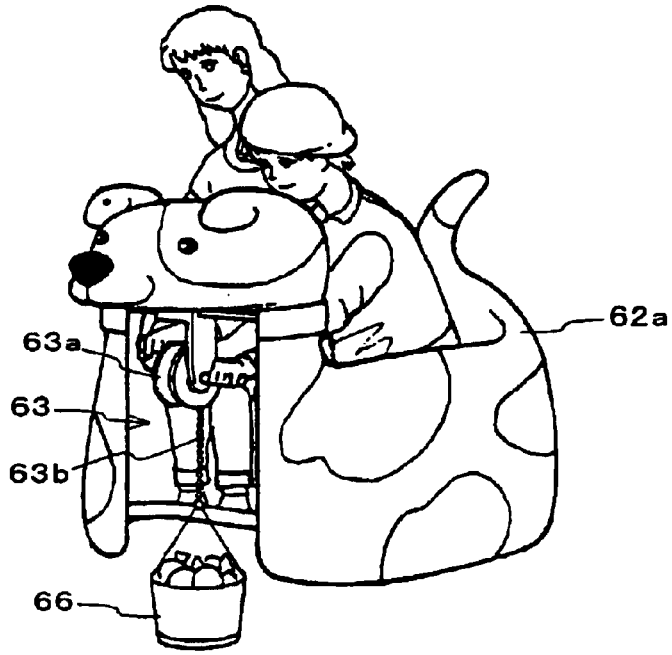
FIG. 9 is a perspective view illustrating still another embodiment of the ride apparatus.

A ride apparatus 62 comprises guide rails 62*b* that are, respectively, disposed inside a pair of parallel upper sides, each of which is opposed to each other on the frames 61*a*, sliders 62*c* that are, respectively, engaged with the two guide rails 62*b* and move in the lengthwise directions, a cross beam 62*d* bridging over the two sliders 62*c*, a guide rail 62*e* secured at the cross beam 62*d*, a slider 62*f* that is engaged with the guide rail 62*e* and moves in the lengthwise direction thereof, a base rack (not illustrated) fixed on the slider 62*f*, a carriage 62*a* that is placed and fixed on the base rack (not illustrated) and is provided with a seat (not illustrated) on which players Y sit, and a driving means (not illustrated) by which the sliders 62*c* and 62*f* are moved. The driving means (not illustrated) is operated by a movement operating switch attached to the carriage 62*a*, wherein the carriage 62*a* is caused to move in the arrow A direction and the arrow B direction. The carriage 62*a* may be embodied in various modes. For example, those shown in FIG. 8 and FIG. 9 are employed in addition to the mode shown in FIG. 7.

The fetching device 63 comprises a winding drum 63*a*, a chain 63*b* wound on the winding drum 63*a*, and a grasping hand 28 attached to the lower end part of the 63*b* and hang therefrom. The grasping hand 28 is devised so as to operate by compressed air that is supplied through a feeding pipe (not illustrated), and the supply of compressed air is controlled by a hand operation switch (not illustrated) secured on the carriage 62*a*. Further, the winding drum 63*a* is rotated by operations made by the players Y, wherein the chain 63*b* is wound and unwound in order to elevate and lower the grasping hand 28.

According to the game apparatus 60, the players Y board the carriage 62*a* and operate the above-described movement operating switch (not illustrated), wherein the carriages 62*a* are caused to move in the arrow A direction and arrow B direction simultaneously or individually. And, when the carriage 62*a* has been moved to a desired position, the players Y close the grasping hand 28 by operating the hand operation switch (not illustrated) after the grasping hand 28 that is opened is lowered by operating the winding drum 63*a*. At this time, if the relative position between the grasping hand 28 and the grab article 7 is appropriate, the grab article 7 can be grasped and picked up by the grasping hand 28 while if the position therebetween is not appropriate, the grab article 7 is not grasped or picked up by the grasping hand 28. Subsequently, by the players Y operating the winding drum 63*a*, the grasping hand 28 is elevated by winding the chain 63*b*, wherein if an grab article 7 is grasped by the grasping hand 28, the players Y can pick it up.

In addition, the winding drum 63*a* may be composed so that it is driven by an electric motor. Also, a disk-shaped fetching means 65 shown in FIG. 8 and a bucket-shaped fetching means 66 shown in FIG. 9 may be employed instead of the grasping hand 28.

Figure 10:
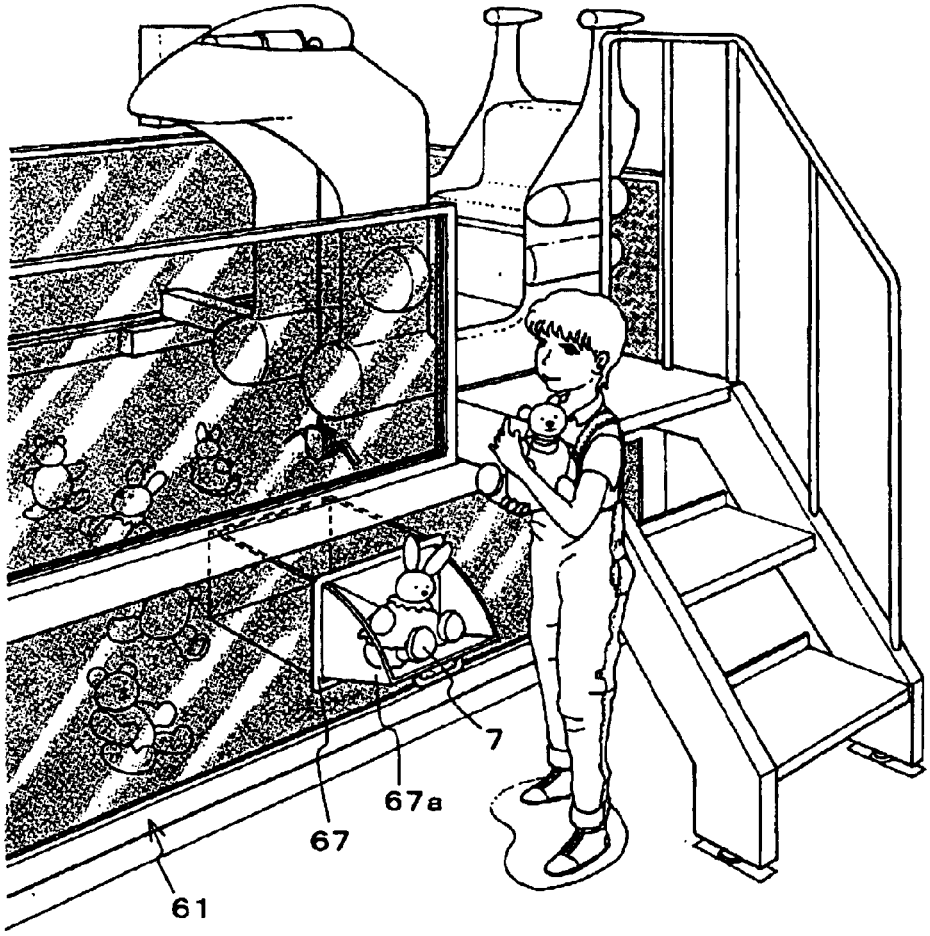
FIG. 10 is a perspective view illustrating another preferred game apparatus.

Further, as shown in FIG. 10, a discharge duct 67 that causes the inside of the holding section 61, that is, the inside of the fetch-play area to communicate with the exterior thereof is provided in the glass plate of the holding section 61. And, the grab article 7 that is grasped by the grasping hand 28 may be provided so that the grab article 7 can be taken out through the discharge duct 67. Also, it is preferable that an openable and closable covering member 67*a* is provided at the open port at the take-out side of the discharge duct 67.

Figure 11:
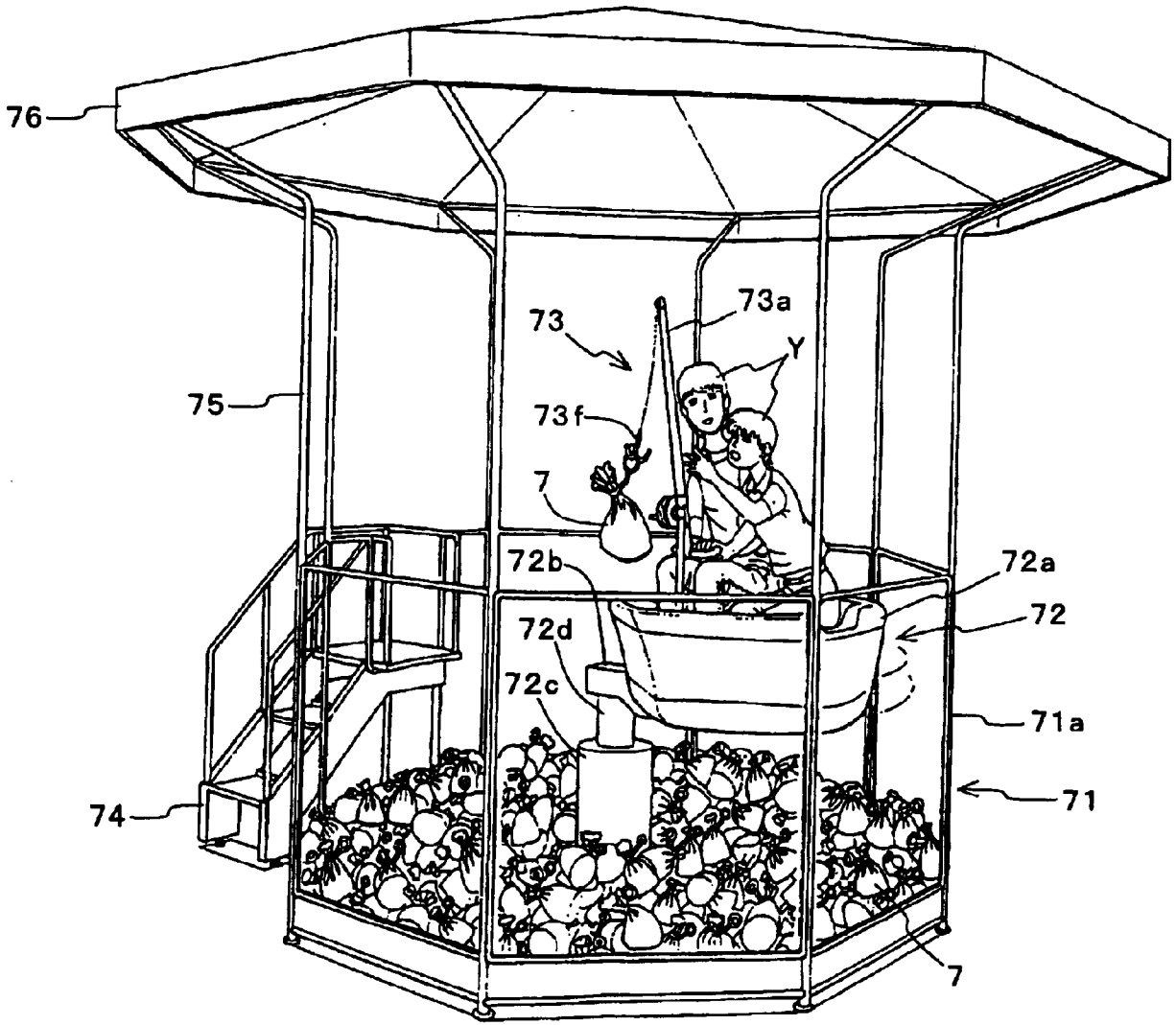
FIG. 11 is a perspective view illustrating still another preferred game apparatus.

In addition, a game apparatus 70 shown in FIG. 11 comprises an holding section 71 that is formed like a casing and accommodates a number of grab articles 7 therein, a ride apparatus 72 that is disposed in the holding section 71 and on which players Y board, and a fetching means 73 for picking up an grab article 7 in the holding section 71.

The holding section 71 is provided with a frame 71*a* that is formed as a framework. The bottom of a space that is formed by the frame 71*a* is closed by the floor surface or a metallic plate, and the side thereof is closed by a glass plate. Also, the upper side of space that is formed by the frame 71*a* is made open.

The ride apparatus 72 comprises a supporting post 72*c* that is erected roughly at the center position in the holding section 71, a rotary axis 72*d* that is rotatably supported in the supporting post 72*c,* a supporting arm 72*b,* one end of which is supported at the rotary axis 72*d,* and a carriage 72*a* that is supported at the other end of the supporting arm 72*b.* The rotary axis 72*d* is devised so as to turn by a rotation driving means (not illustrated) such as an electric motor. Also, the players Y are able to board the carriage 72*a* using steps 74 secured at the surrounding of the holding section 71.

Figure 12:
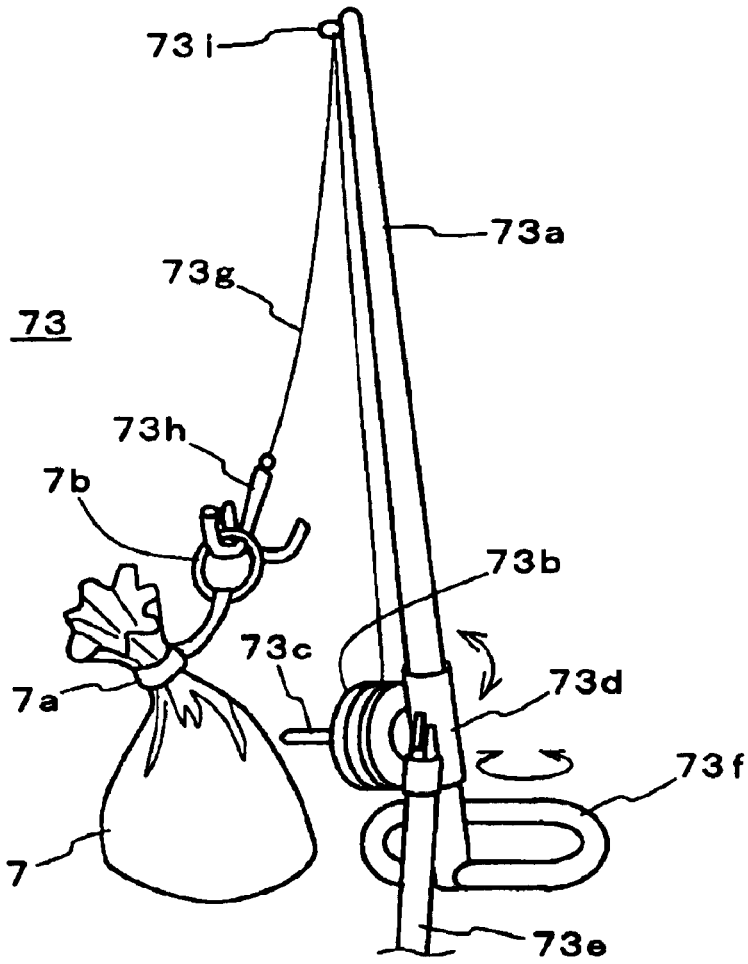
FIG. 12 is a perspective view illustrating a fetching device thereof.

The fetching means 73 comprises, as shown in FIG. 12, a rod-like member 73*a,* a supporting post 73*e* that supports the rod-like member 73*a* via a linkage 73*d,* a winding drum 73*b* that is rotatably attached to the rod-like member 73*a,* a ring 73*i* secured at one end of the rod-like member 73*a,* a line 73*g* that is wound in the winding drum 73*b* via the ring 73*i,* an annular operating member 73*f* secured at the other end of the rod-like member 73*a,* and a hooking member 73*h* that is provided at the tip end of the line 73*g.* The linkage 73*d* causes the rod-like member 73*a* and supporting post 73*e* to rotate relatively and move relative to each other, for example, centering around the vertical axis and horizontal axis, wherein the players Y are able to move the end portion at the ring 73*i* side of the rod-like member 73*a* to any optional position in a three-dimensional space by moving the operation member 73*f.* In addition, the winding drum 73*b* is provided with a handle 73*c,* wherein the players Y operate the handle 73*c* to turn the winding drum 73*b,* thereby causing the line 73*g* to be wound in the winding drum 73*b* or contrarily causing the line 73*g* to be unwound from the winding drum 73*b.*

Grab articles 7 are, respectively, packed in a sack, the opening of which is sealed by using a band 7*a* having a ring 7*b.* Further, the hooking member 73*h* consists of a three-pronged and hook-like member, wherein each hook is engageable with the rings 7*b* of the grab articles 7. Also, a roof 76 supported by the supporting posts 75 are provided upward of the accommodation part 71.

According to the game apparatus 70, the rotary axis 72*d* is driven to rotate by a rotation driving member (not illustrated) after players Y board the carriage 72*a*, whereby the carriage 72*a* rotates and moves on the horizontal plane centering around the rotary axis 72*d.* In this state, the players Y operate the handle 73*c* that is secured at the winding drum 73*b* and delivers the line 73*g* from the winding drum 73*b* to lower the hooking member 73*h.* Thereby, the hooking member 73*h* swivels and moves together with the carriage 72*a* while being brought into contact with an grab article 7 accommodated in the holding section 71. And, a player Y controls the position of the hooking member 73*h* moving in such a state by moving the rod-like member 73*a,* and moves the hook of the hooking member 73*h* so that it is engaged with the ring 7*b* of an grab article 7. By doing so, after the hook of the hooking member 73*h* is engaged with the ring 7*b* of the grab article 7, the player Y winds the line 73*g* by operating the winding drum 73*b,* wherein the hooking member 73*h* is elevated and the player Y picks up the grab article 7 caught by the hooking member 73*h.*

Also, the winding drum 73*a* may be constructed so that it is driven by an electric motor. Further, instead of the hooking member 73*h,* a grasping hand 28 shown in FIG. 7, a disk-like fetching means 65 shown in FIG. 8, and a bucket-like fetching means 66 shown in FIG. 9 may be used.

Figure 13:
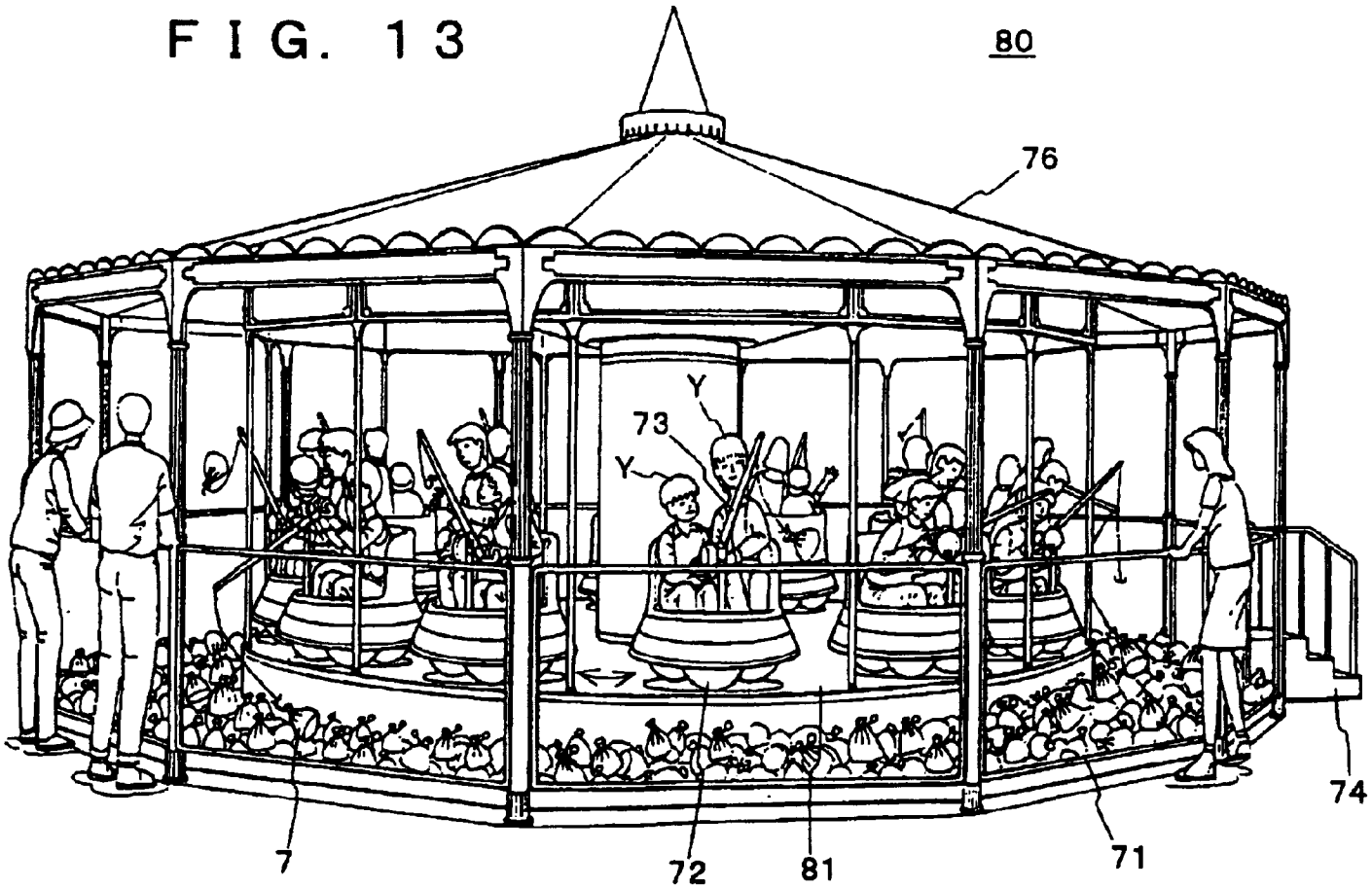
FIG. 13 is a perspective view illustrating yet another preferred game apparatus.

In addition, the basic construction of the game apparatus 70 shown in FIG. 11 may be applicable to a game apparatus 80 shown in FIG. 13. The game apparatus 80 shown in FIG. 13 is constructed so that the holding section 71 is formed to be annular, a circular stage 81 is provided inside the holding section 71, and a plurality of ride apparatuses 72 and fetching means 73 are provided on the stage 81. The stage 81 horizontally turns in the arrow direction, and players Y can enjoy playing the above-described game on the ride apparatuses 72 that rotate along with the stage 81.

Figure 14:
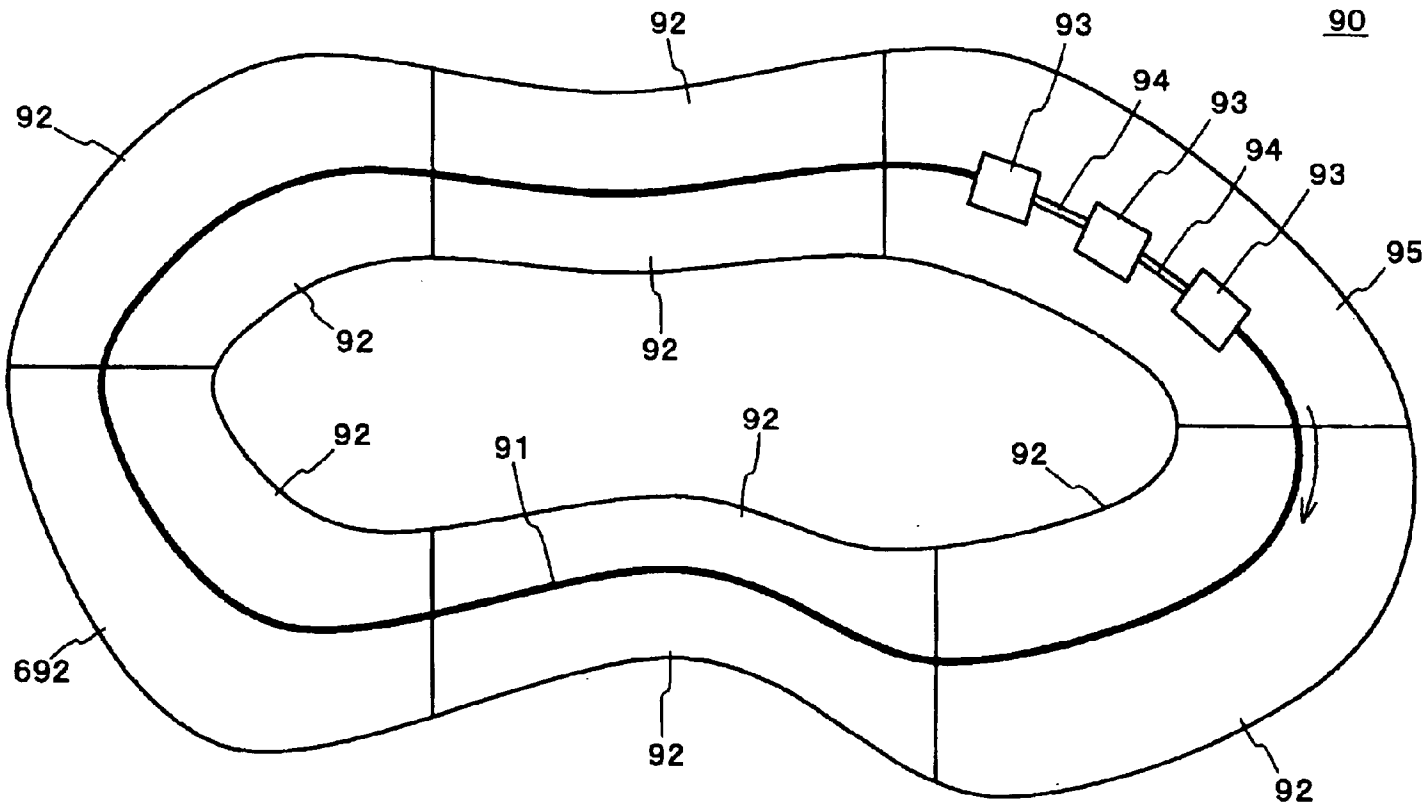
FIGS. 14 through 17 are plan views illustrating other preferred game apparatuses.

A game apparatus 90, according to a mode that is shown in FIG. 14, comprises a travelling rail 91 that is a track, which is formed like a loop, a plurality of sections of holding sections 92, which are formed around the travelling rail 91, and a plurality of ride vehicles 93 (three vehicles in the embodiment shown herein) that travel on and along the travelling rail 91. The travelling rail 91 consists of two parallel rails that are used like a track of a train, and the ride vehicle 93 may have a structure similar to that of a truck, and a plurality of trucks are linearly coupled to each other by linkage rods 94, wherein at least the top truck is provided with a drive device and the trucks are auto-driven to run. In addition, the travelling rails 91 may be composed of a single rail, and the ride vehicle 93 may be composed of a vehicle having a structure just like a monorail car.

Further, respective ride vehicles 93 are provided with a fetching means similar to the above-described fetching device 25. Also, the holding sections 92 that are sectioned in a plurality are provided with objects. However, where the same objects are provided, it is not necessary to section the holding sections in a plurality as in the present embodiment. A platform 95 facilitates players Y getting on or off ride vehicles 93. According to the game apparatus 90 of the present embodiment, since players Y board ride vehicles 93 and enjoy picking up objects while moving thereon, effects similar to those of the above-described game apparatus 1 can be brought about. Also, the embodiment shows an example in which a plurality of ride vehicles 93 are coupled to each other. However, respective ride vehicles 93 are not coupled to each other, and they may be constructed so that they run independently.

Figure 15:
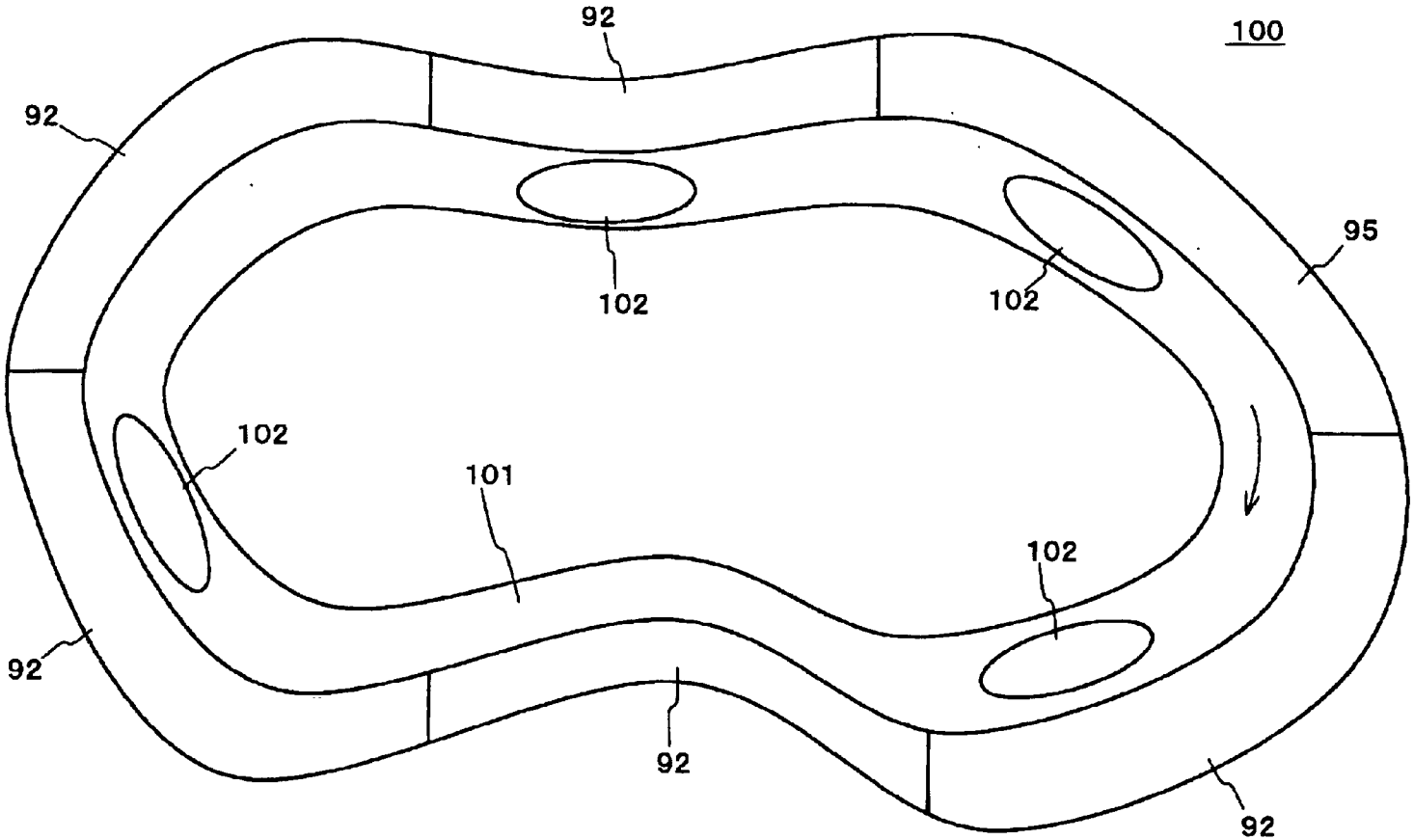

Further, a game apparatus 100 shown in FIG. 15 is a modification of the above-described game apparatus 90, wherein a waterway 101 is formed instead of travelling rails 91, and boats 102 are provided for the ride vehicles 93, and they are constructed so that they are self-driven and advance in the waterway 101 or they advance by streams of the waterway 101. Also, the respective boats 102 are provided with a fetching means that is similar to the above-described fetching device 25. According to the game apparatus 100 of the embodiment, players Y board the boats 102 and enjoy picking up an object while moving, effects similar to those of the game apparatus 1 can be brought about. In addition, the boats 102 may be constructed so that they are linearly coupled to each other.

Figure 16:
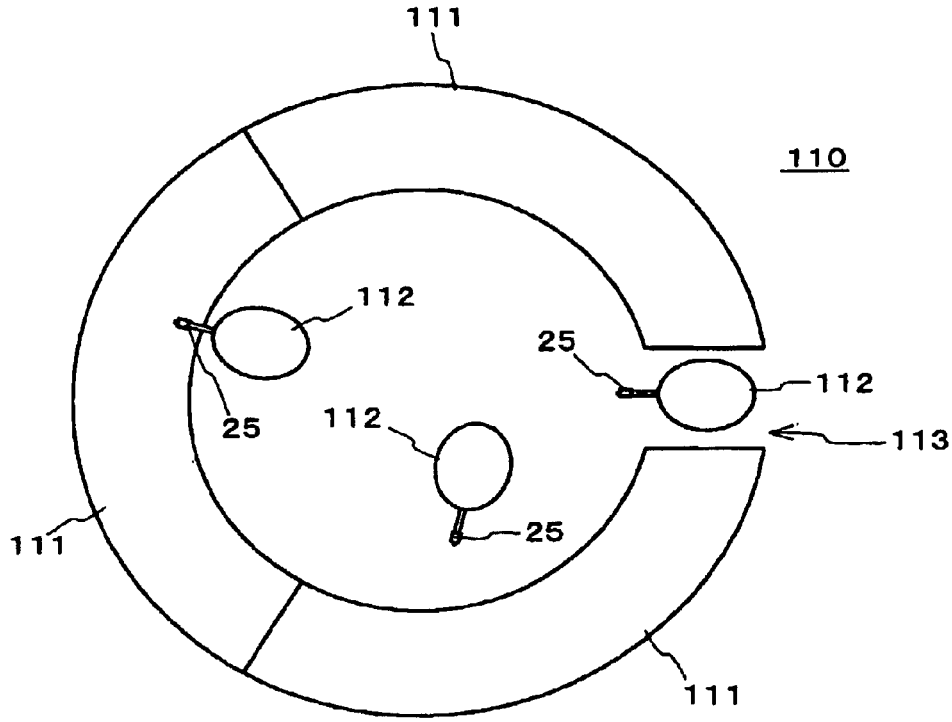

A game apparatus 110 according to the embodiment shown in FIG. 16 comprises an holding section 111 that is formed to be C-shaped in its plan view, and a self-driven ride vehicle 112 which is provided with the above-described fetching device 25. The ride vehicle 112 may be of any type that can freely travel, for example, a vehicle like an automobile that can move by means of wheels, a vehicle like a civil engineering machine that moves by means of caterpillars. According to the game apparatus 110, a player Y boards a ride vehicle 112 and steers to drive a ride vehicle 112, wherein the player Y drives the ride vehicle 112 to advance through the cut-open section 113 of the holding section 111 into the inside area and enjoys picking up an object as described above. Thus, according to the game apparatus 110, since the player Y boards a ride vehicle that freely travels and enjoys the above-described fetching game, the player Y can physically feels a sense of reality and motions, and satisfy himself in regard to curiosity pertaining to operations of the fetching device 25, wherein the players Y enjoy a game that is filled with interests. Also, in this case, the ride vehicles 112 may be provided so as to freely rotate around the vertical axis. In addition, the holding section 111 may be constructed so that it is formed to be circular in its plan view as shown in FIG. 17 and the ride vehicles 112 travel around the holding section 111.

Figure 17:
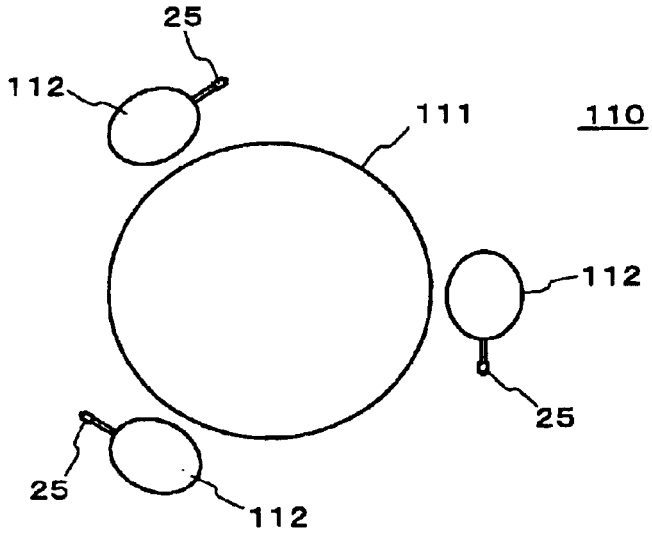

Still further, in the example that is shown in FIG. 16 and FIG. 17, such a construction may be employed, in which the ride vehicles 112 are disposed and fixed around the holding section 111, and are provided so as to rotate around the vertical axis, and the fetching device 25 is provided so as to move above the holding section 111. Further, if the ride vehicles 112 are supported by a swivel arm and the swivel arm is turned, the ride vehicles 112 may be movable above the holding section 111. Also, in this case, the ride vehicles 112 may be of such a type that cannot be auto-driven.

Figure 18:
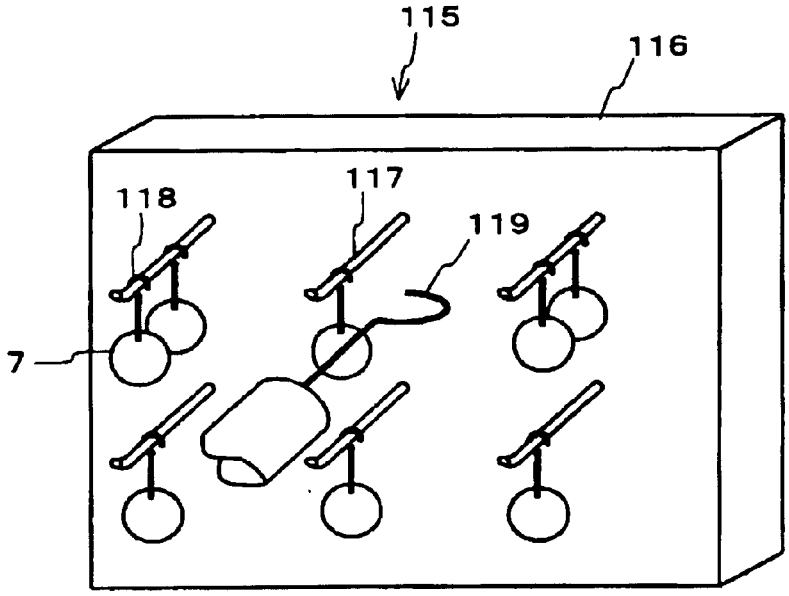
FIG. 18 is an oblique view depicting a holding section in a different embodiment.
Figure 19:
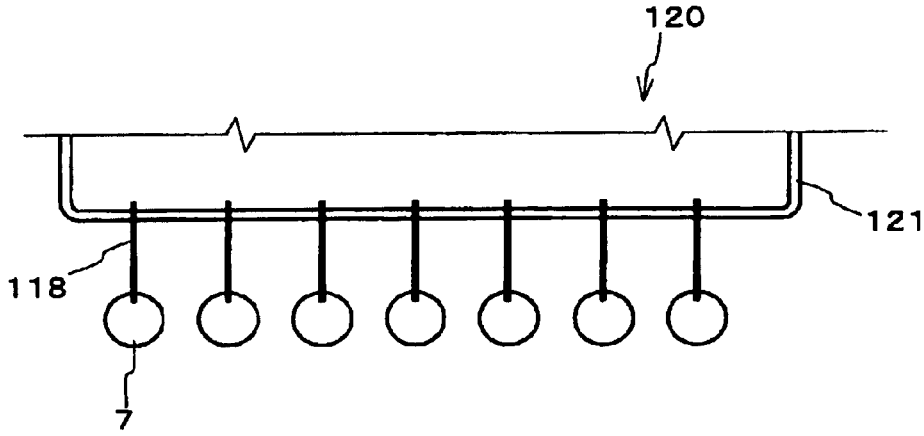
FIG. 19 is an elevational view depicting a holding section in a different embodiment.
Figure 20:
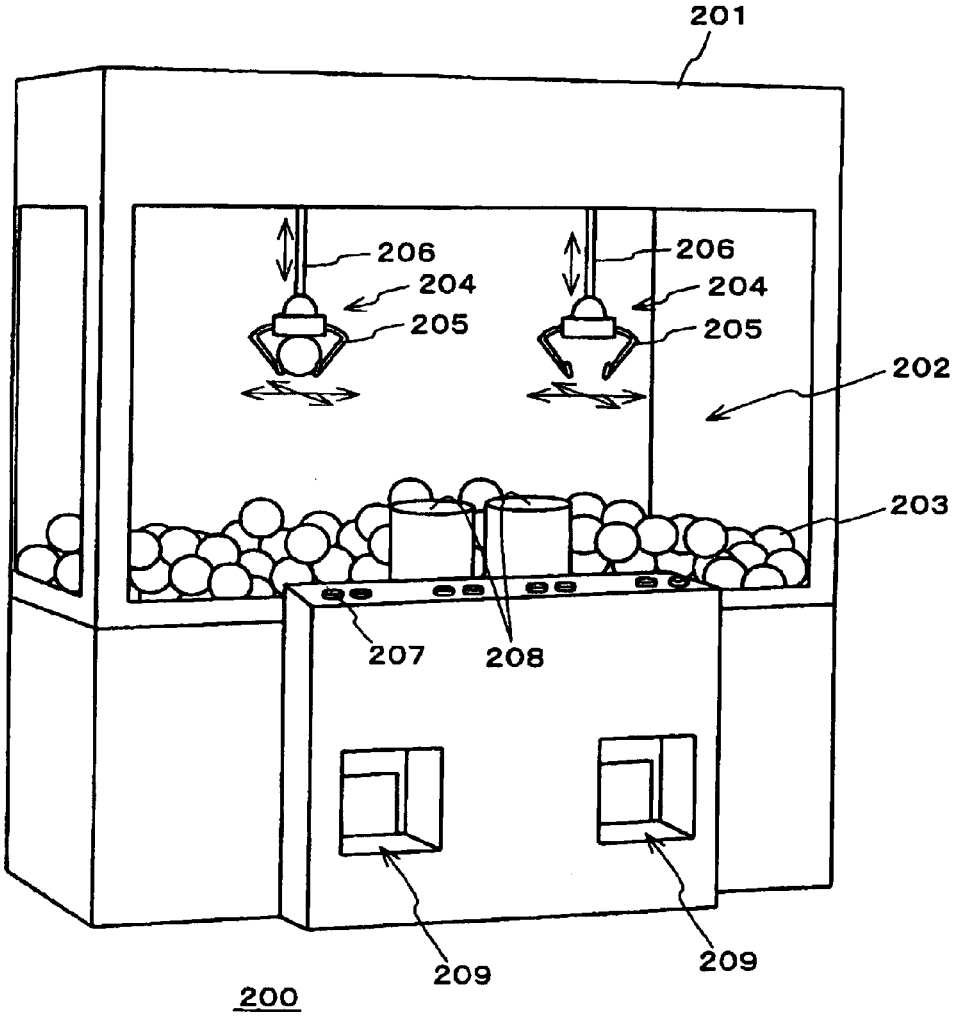
FIG. 20 is a perspective view illustrating a conventional game apparatus.

Still further, the fetching device 25, 63 and 73 that are shown in FIG. 1 through FIG. 17 are not limited to the above-described configurations. They may be constructed so that they are provided with a so-called magic hand, rake-like hand, a mechanism for holding an object in a bucket as in a shovel mechanism used for a civil engineering machine such as a hydraulic power shovel, bulldozer, etc., a mechanism for adsorbing an object by a suction device, etc. The above-described holding sections 6, 61, 71, 92 and 111 are constructed like a vessel having an appointed accommodation capacity. However, instead of the holding sections, such a structure may be employed as an holding section 115, in which, as shown in FIG. 18, a plurality of supporting bars 117 are provided so as to protrude from the side of the supporting body 116, and grab articles 7 are hung from respective supporting bars 117 via engagement hooks 118, and as shown in FIG. 19, such a structure may be also employed as an holding section 120, in which grab articles 7 are hung from a supporting member 121 supported on the ceiling, etc., via engagement hooks 118.

Where such an holding section 115 or 120 is used, the above-described fetching device 25 is composed of a mechanism having a hook 119, the hook 119 is engaged with the engagement hook 118, and the grab article 7 is taken out and picked up a supporting bar 117, and the fetching device 25 is composed of a mechanism having a magic hand, wherein the grab article 7 is grasped by the magic hand, taken out and picked up from the supporting member 121.

As described above, various types of structures may be employed for the above-described holding sections 6, 61, 71, 92 and 111, and the fetching device 25. Therefore, these various types of holding sections are disposed in a fetch-play area, and various types of fetching means are provided in a ride apparatus, wherein the fetching means may be separately used on the basis of the types of holding sections. Also, grab articles 7 of different patterns may be, respectively, accommodated in the above-described holding sections 92 and 111 that are sectioned in a plurality, and the patterns of accommodation may be made different from each other.

For example, as regards the patterns of objects, there are various types, for example, a type in which premiums such as character goods, medals, coins, lottery tickets, cards, etc., are accommodated in a capsule, balloon, and bag-like container, a type in which they are not accommodated such as a container, and a type in which the shapes of containers are made different from each other and are provided in a mixed state. Further, in connection to the accommodation patterns in the holding sections, there are various modes, for example, a mode in which objects are accommodated as they are, a mode in which objects accommodated in an holding section are caused to flow due to air streams, a mode in which the holding sections 92 and 111 are filled with water, on or in which objects are floated or sunk, and in this case, the objects may be living things such as marine animals.

Also, components in the respective embodiments may be appropriately combined in these embodiments. For example, the discharge duct 8 that is shown in FIG. 1, FIG. 2 and FIG. 5, and the discharge duct 67 that is shown in FIG. 10 may be provided in the holding sections 6, 61, 71, 92 and 111 in other embodiments. Similarly, the collection portion 34 that is shown in FIG. 3 may be provided in ride apparatuses 10, 62, 72, 93 102, and 112 in other embodiments. In addition, the roof 76 that is shown in FIG. 11 and FIG. 13 may be provided in other embodiments, and the entire space in which the above-described fetch-play area may be constructed so that it is enclosed by a transparent covering member.

As described above, a game apparatus according to the present invention is suitable for a game apparatus with which a player himself can physically feel a sense of reality and motion, satisfy himself in regard to curiosity pertaining to mechanical operations, and enjoy himself in a game which is filled with interest.

What is claimed is:

1. A game apparatus bearing a player-rider to let the player-rider attempt to capture prizes, the game apparatus comprising:

a holding section for holding a plurality of grab articles;

a ride means far bearing at least one player-rider to let the player-rider access said holding section;

fetching means installed onto said ride means for fetching a grab article in said holding section through player-rider operations; and a carriage means associated with said ride means for moving said ride means to control the player-rider's access to said holding section.

2. The game apparatus set forth in claim 1, further comprising means for imparting vibration to said fetching means.

3. The game apparatus set forth in claim 1, wherein said holding section is established within a fixed fetch-play area; and further comprising a discharge means for discharging from within the fetch-play area to without the fetch-play area grab articles fetched by said fetching means.

4. The game apparatus set forth in claim 1, wherein said ride means is equipped with collection means for collecting into said ride means grab articles fetched by said fetching means.

5. The game apparatus set forth in claim 1, further comprising means for flow-circulating the grab articles held in said holding section.

6. A game apparatus set forth in claim 1, wherein:

said ride means is shiftable linearly apart from said holding section; and carriage means includes a rail for bearing said ride means to said holding section.

7. A game apparatus set forth in claim 6, further comprising a plurality of said ride means surrounding said holding section.

8. A game apparatus set forth in claim 7, wherein said holding section is configured for rotating in an approximately horizontal plane.

9. A game apparatus set forth in claim 1, wherein said holding section is disposed under said ride means.

10. A game apparatus set forth in claim 9, wherein said ride means is pivotably mounted over said holding section.

11. A game apparatus set forth in claim 1, further comprising a plurality of said ride means and carriage means; wherein said holding section is disposed under said plurality of said ride means;

each carnage means including an overhead rail for linearly bearing said ride means over said holding section; and each said rail is radially disposed for rotation about a common center.

12. A game apparatus set forth in claim 1, further comprising a plurality of ride means;

wherein said holding section surrounds said plurality of said ride means.

13. A game apparatus further comprising:

a holding section for holding a plurality of grab articles within a fixed area:

a ride apparatus equipped with a boarding section for at least one player to board, said boarding section being established to be shiftable and/or rotatable;

fetching means installed onto said ride apparatus for, through player operations, fetching the grab articles in said holding section; and a track, wherein said ride apparatus is adapted for travelling along said track.

14. A game apparatus carrying a player-rider to let the player-rider attempt to capture prizes, the game apparatus comprising:

a holding section for holding a plurality of grab articles;

a ride means for bearing and shifting at least one player-rider to let the player-rider access said holding section;

fetching means installed onto said ride means for fetching a grab article in said holding section through player-rider operations; and a carriage means associated with said ride means for shifting in at least one linear direction or rotating said ride means to control the player-rider's access to said holding section.

* * * * *